US011324347B2

(12) United States Patent
Rindlisbacher

(10) Patent No.: US 11,324,347 B2
(45) Date of Patent: May 10, 2022

(54) ANTI-FATIGUE MAT

(71) Applicant: Stephen Rindlisbacher, Pleasant Grove, UT (US)

(72) Inventor: Stephen Rindlisbacher, Pleasant Grove, UT (US)

( * ) Notice: Subject to any disclaimer, the term of this patent is extended or adjusted under 35 U.S.C. 154(b) by 0 days.

(21) Appl. No.: 16/875,027

(22) Filed: May 15, 2020

(65) Prior Publication Data

US 2021/0353085 A1 Nov. 18, 2021

(51) Int. Cl.
*A47G 27/02* (2006.01)
*A63B 22/18* (2006.01)

(52) U.S. Cl.
CPC ..... *A47G 27/0231* (2013.01); *A63B 22/18* (2013.01); *A63B 2208/0204* (2013.01)

(58) Field of Classification Search
CPC . A63B 22/203; A63B 21/068; A63B 23/1236; A63B 22/20; A63B 21/0004; A63B 21/4035; A63B 23/0233; A63B 2208/0295; A63B 21/4034; A63B 2208/0219; A63B 23/0211; A63B 23/0216; A63B 22/16; A63B 22/18; A63B 2208/0204; A47G 27/0231
See application file for complete search history.

(56) References Cited

U.S. PATENT DOCUMENTS 3,352,559 A * 11/1967 Larsen ..... A63B 69/3667 473/269
5,810,673 A * 9/1998 Castleberry ..... A63B 69/3673 473/217
6,749,529 B1 * 6/2004 Sobolewski ..... A63B 22/14 473/451
7,335,117 B2 * 2/2008 Reason-Kerkhoff ..... A63B 69/0002 473/217
8,282,502 B1 * 10/2012 Angstead ..... A63B 69/3661 473/278
8,371,963 B2 * 2/2013 DelGreco ..... A63B 69/0002 473/452
8,702,574 B2 * 4/2014 Abranchess ..... A63B 23/0355 482/141
9,079,072 B2 * 7/2015 Agostini ..... A63B 21/4035
9,205,318 B2 * 12/2015 Chiono ..... A63B 57/40
9,216,340 B2 * 12/2015 DelGreco ..... A63B 69/0002
9,616,294 B2 * 4/2017 Kramer ..... A63B 23/1236
9,861,220 B2 * 1/2018 Burkhalter ..... B32B 25/08
10,045,647 B2 * 8/2018 Publicover ..... A63B 21/068
10,052,520 B2 * 8/2018 Kramer ..... A63C 17/016
10,219,644 B2 * 3/2019 Feeley ..... A47G 27/0231
(Continued)

*Primary Examiner* — Garrett K Atkinson
(74) *Attorney, Agent, or Firm* — Christopher Pilling

(57) ABSTRACT

An improved anti-fatigue mat is provided. The anti-fatigue mat includes a base member constructed from an elastomeric material configured to receive a foot or shoe of a user. A disk configured to rotate is provided, the disk having a disk top surface, wherein the disk top surface is flush or approximately flush with at least a portion of the base top surface. A substantial portion of the disk is embedded into the base member. The rotating disk is configured to rotate 360 degrees in both a clockwise and a counterclockwise direction enabling a user to rotate the disk in either direction via leg movements. A plurality of raised elements protruding from the top surface of the base member may be optionally provided.

7 Claims, 8 Drawing Sheets

(56) References Cited

U.S. PATENT DOCUMENTS

| | | | | |
|---|---|---|---|---|
| D906,011 | S * | 12/2020 | Hu | D6/592 |
| 2003/0224882 | A1* | 12/2003 | Mahoney | A63B 69/0002 473/452 |
| 2010/0317496 | A1* | 12/2010 | Abranchess | A63B 21/4035 482/141 |
| 2012/0190484 | A1* | 7/2012 | DelGreco | A63B 69/0002 473/452 |
| 2012/0252645 | A1* | 10/2012 | Agostini | A63B 21/0004 482/132 |
| 2013/0184131 | A1* | 7/2013 | Doyle | A63B 23/0355 482/139 |
| 2013/0269112 | A1* | 10/2013 | Legare | A47G 27/0231 5/648 |
| 2014/0155199 | A1* | 6/2014 | DelGreco | A63B 69/0002 473/452 |
| 2014/0179452 | A1* | 6/2014 | Chiono | A63B 69/3676 473/181 |
| 2016/0174745 | A1* | 6/2016 | Feeley | A47G 27/0231 428/80 |
| 2016/0255977 | A1* | 9/2016 | Burkhalter | B32B 15/14 |
| 2017/0172331 | A1* | 6/2017 | Publicover | A63B 26/003 |
| 2018/0133553 | A1* | 5/2018 | Kramer | A63B 21/4033 |
| 2018/0303575 | A1* | 10/2018 | Nardo | A61B 90/60 |
| 2018/0360250 | A1* | 12/2018 | Publicover | A63B 21/0602 |
| 2019/0380906 | A1* | 12/2019 | Lin | A61H 15/00 |

* cited by examiner

ANTI-FATIGUE MAT

BACKGROUND OF THE INVENTION

1. Field of the Invention

The present invention relates generally to mats, but more particularly to an improved anti-fatigue mat.

2. Description of Related Art

As well known in the art, anti-fatigue mats are configured to help users working in standing positions for prolonged periods of time. The anti-fatigue mats help to stimulate blood flow in the legs and lower extremities resulting in improved blood circulation and less fatigue.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

In one aspect of the invention, an improved anti-fatigue mat is provided, comprising a base member constructed from an elastomeric material, the base member having a top surface configured to receive a foot or shoe of a user; and, a disk configured to rotate, wherein a substantial portion of the disk is embedded into the base member.

In one embodiment, the elastomeric material is rubber, closed-cell foam, polypropylene, ploy-vinyl chloride, or a combination thereof. In another embodiment, the disk has a flat top surface. In one embodiment, the flat top surface of the disk is approximate to at least a portion of the top surface of the base member. In yet another embodiment, a plurality of raised elements protruding from the top surface of the base member is provided. In one embodiment, at least one of the plurality or raised elements includes a textured surface. In another embodiment, the base member is rectangular. In yet another embodiment, the disk is configured to rotate 360 degrees in both a clockwise and a counterclockwise direction.

In another aspect of the invention, an improved anti-fatigue mat is provided, comprising a base member constructed from an elastomeric material, the base member having a base top surface configured to receive a foot or shoe of a user; and, a disk configured to rotate, the disk having a disk top surface, wherein the disk top surface is flush with at least a portion of the base top surface.

In one embodiment, a substantial portion of the disk is embedded into the base member. In another embodiment, the disk top surface is flat. In yet another embodiment, the disk is configured to rotate 360 degrees in both a clockwise and a counterclockwise direction. In one embodiment, the elastomeric material is rubber, closed-cell foam, polypropylene, ploy-vinyl chloride, or a combination thereof. In one embodiment, a plurality of raised elements protruding from the top surface of the base member is provided. In one embodiment, wherein at least one of the plurality or raised elements includes a textured surface. In yet another embodiment, the base member is rectangular.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable any person skilled in the art to make and use the invention and sets forth the best modes contemplated by the inventor of carrying out their invention. Various modifications, however, will remain readily apparent to those skilled in the art, since the general principles of the present invention have been defined herein to specifically provide an improved anti-fatigue mat.

As used herein, the singular forms "a," "an," and "the" include plural references unless the context clearly dictates otherwise. Any reference to "or" herein is intended to encompass "and/or" unless otherwise stated. As used in this application, the term "about" or "approximately" refers to a range of values within plus or minus 10% of a specified number or positioning.

Referring now to FIGS. 1-2 and 5-6, various views of an improved anti-fatigue mat 100 are illustrated. In one embodiment, the improved anti-fatigue mat 100 comprises a base member 105 having a top surface configured to receive a foot or shoe 130 of a user. In one embodiment, the improved anti-fatigue mat 100 and base member 105 is rectangular, however other shapes may be used. In some embodiments, the top surface includes a variety of features. In other embodiments, it is a basic plan flat surface. The variety of features include, but are not limited to, a plurality of raised elements 110/115/125 protruding from the top surface of the base member. The plurality of raised elements may be a variety of shapes, heights, textures, and locations on the base member giving the user a unique terrain to utilize on the anti-fatigue mat. The locations plurality of raised elements may be positioned anywhere on the mat, including but not limited to, the edges or borders of the mat, or any central location defined as any position on the mat inside the edges or borders. In some embodiments, providing one or more raised elements of the plurality of raised elements on the edges or borders helps keep the user on the mat when in use. However, it should be understood that these are optional features and the location, number, and occurrence of these features may vary.

In one embodiment, the base member 105 is constructed from an elastomeric material configured to provide relief to the user as well as help to stimulate blood flow in the legs and lower extremities resulting in improved blood circulation and less fatigue for the user. In some embodiments, the elastomeric material is rubber, closed-cell foam, polypropylene, ploy-vinyl chloride, or a combination thereof. However, it should be understood that other materials may be used without departing from the spirit and scope of the invention.

Figure 1:
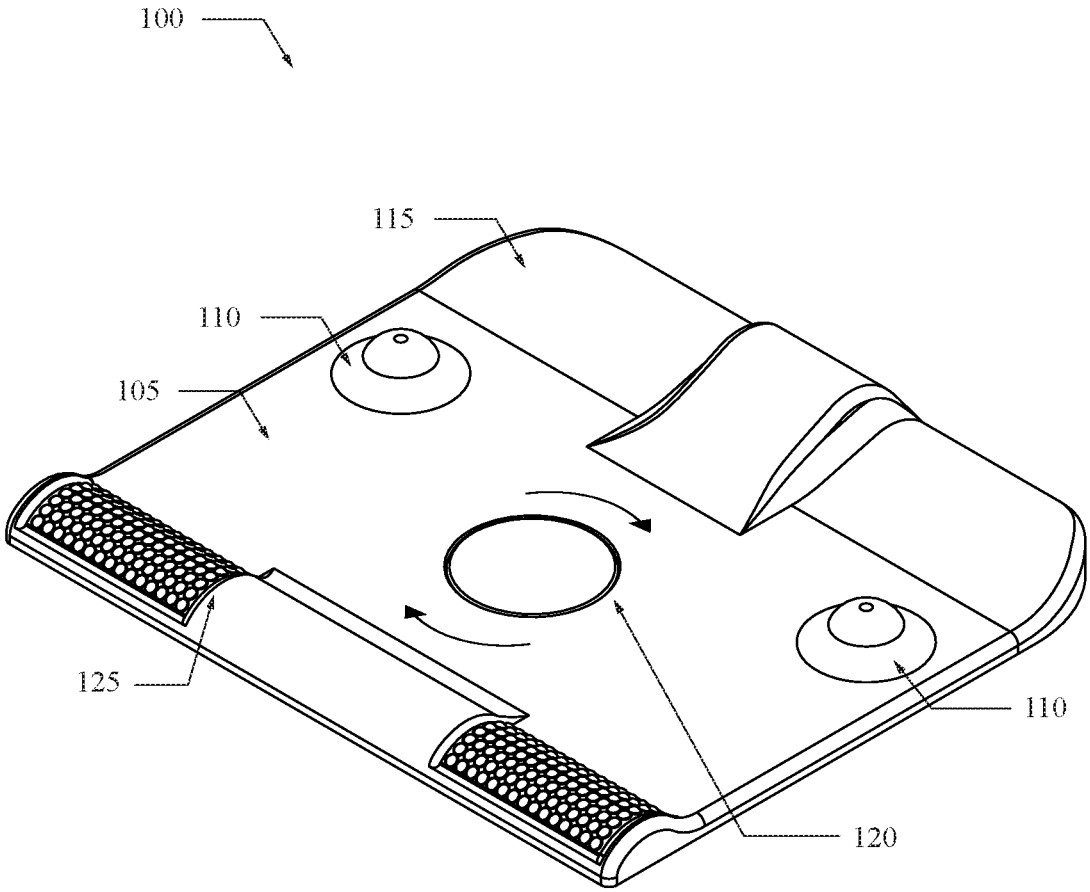
FIG. 1 is a perspective view of an improved anti-fatigue mat according to an embodiment of the present invention.
Figure 2:
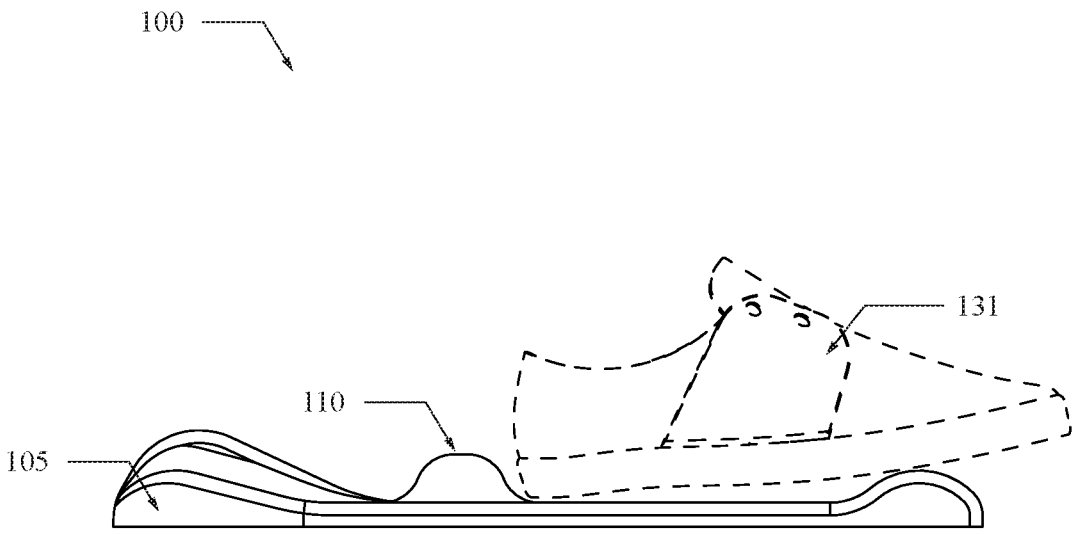
FIG. 2 is a side view of the improved anti-fatigue mat in use according to an embodiment of the present invention.

It is a particular advantage of the improved anti-fatigue mat 100 to provide a rotating disk 120. The rotating disk is configured to rotate 360 degrees in both a clockwise and a counterclockwise direction. The rotating disk enables the user to rotate the disk via their leg movements in either direction. In one embodiment, the disk is provided in the center of the improved anti-fatigue mat 100, however, it should be understood that the location of the disk may vary. In one embodiment, the disk has a flat top surface, however various textures may be provided. In one embodiment, a substantial portion of the disk is embedded into the base member. A substantial portion is defined as 75% or more of the height of the disk being embedded into the base member, which exposes 25% or less of the disk above the base member. Visually, this can be seen in the accompanying FIGS. 1-8. In some embodiments, the disk is either entirely embedded or approximately entirely embedded such that the top surface of the disk is approximate to at least a portion of the top surface of the base member. In FIGS. 1-2, the disk is entirely embedded and the top surface of the disk is flush with at least a portion of the top surface of the base member. One skilled in the art may appreciate that the top surface of the base member may vary in height, slope, and terrain. Thus, in most embodiments, the top surface of the disk must be flush or approximately flush with at least a portion of the top surface of the base member. Having the disk substantially embedded in the base member, wherein the top surface of the disk is at least approximately flush with at least a portion of the top surface of the base member provides several advantages, including but not limited to, support for the rotating disk, preventing damage to the disk, preventing user accidents when using the disk, as well as providing a smooth transitional surface from the top surface of the base member to the to surface of the disk for the user.

Figure 3:
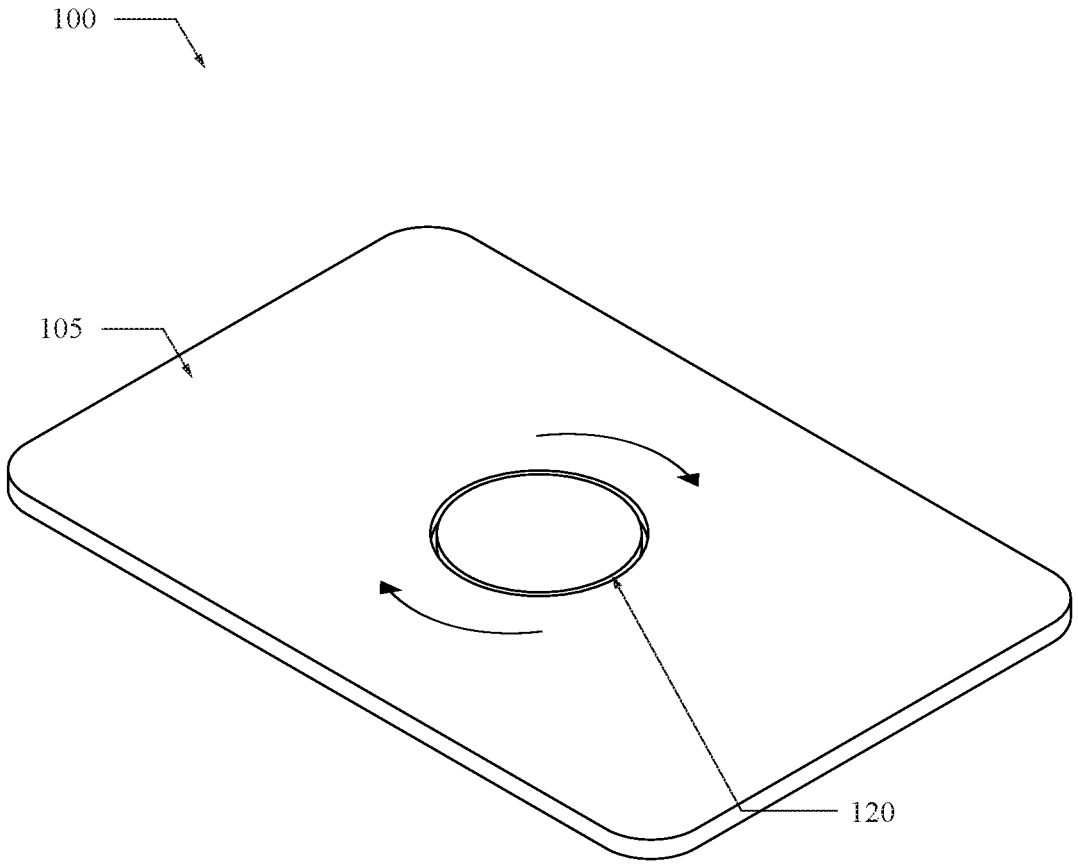
FIG. 3 is a perspective view of an alternative improved anti-fatigue mat according to an embodiment of the present invention.
Figure 4:
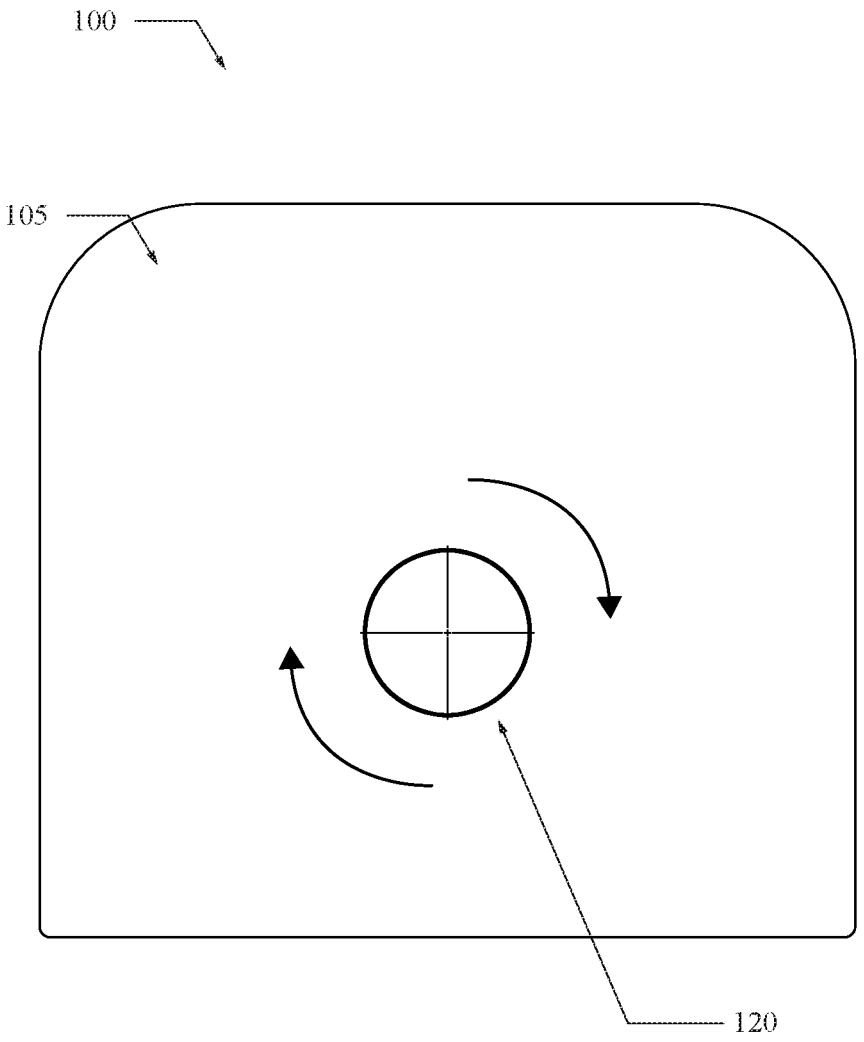
FIG. 4 is a top view of the alternative improved anti-fatigue according to an embodiment of the present invention.
Figure 5:
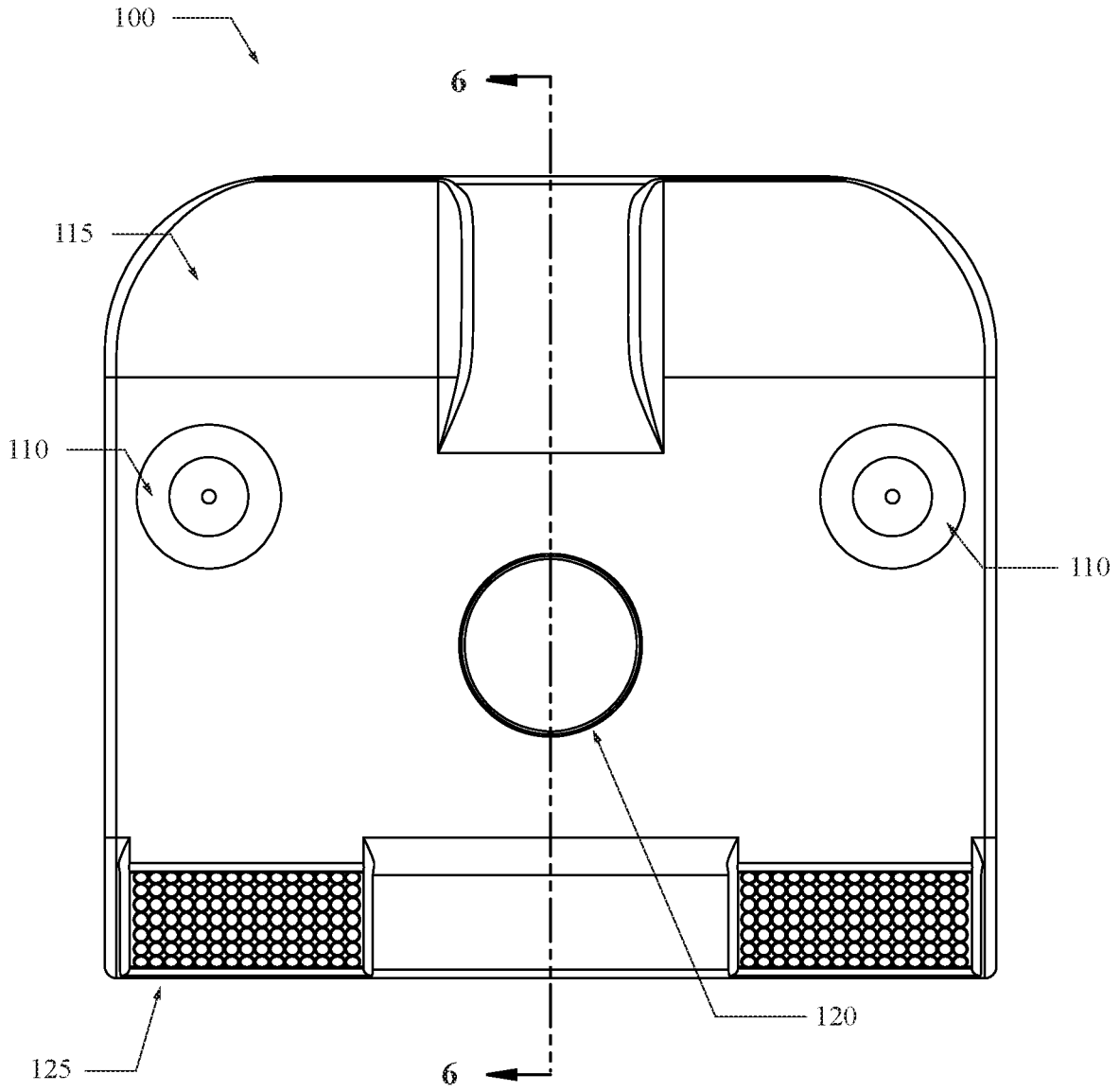
FIG. 5 is a top view of the improved anti-fatigue according to an embodiment of the present invention.
Figure 6:
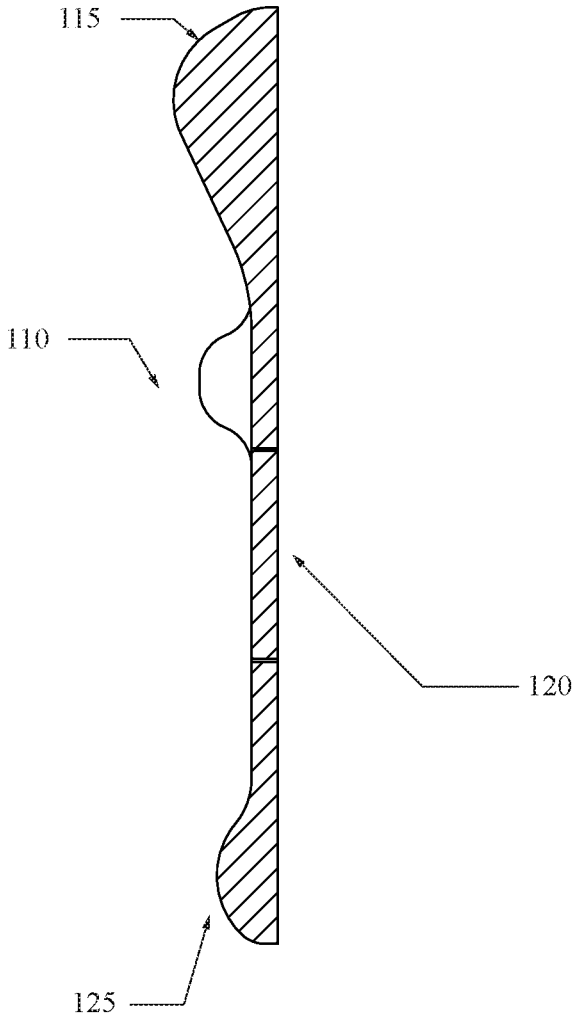
FIG. 6 is a sectional view of the improved anti-fatigue mat according to an embodiment of the present invention.

Referring now to FIGS. 3-4, various views of an alternative improved anti-fatigue mat 100 are illustrated. The alternative improved anti-fatigue mat is similar to the anti-fatigue mat previously discussed, however, in this embodiment, the anti-fatigue mat only includes the rotating disk 120 on a base member 105 having no other features.

Figure 7:
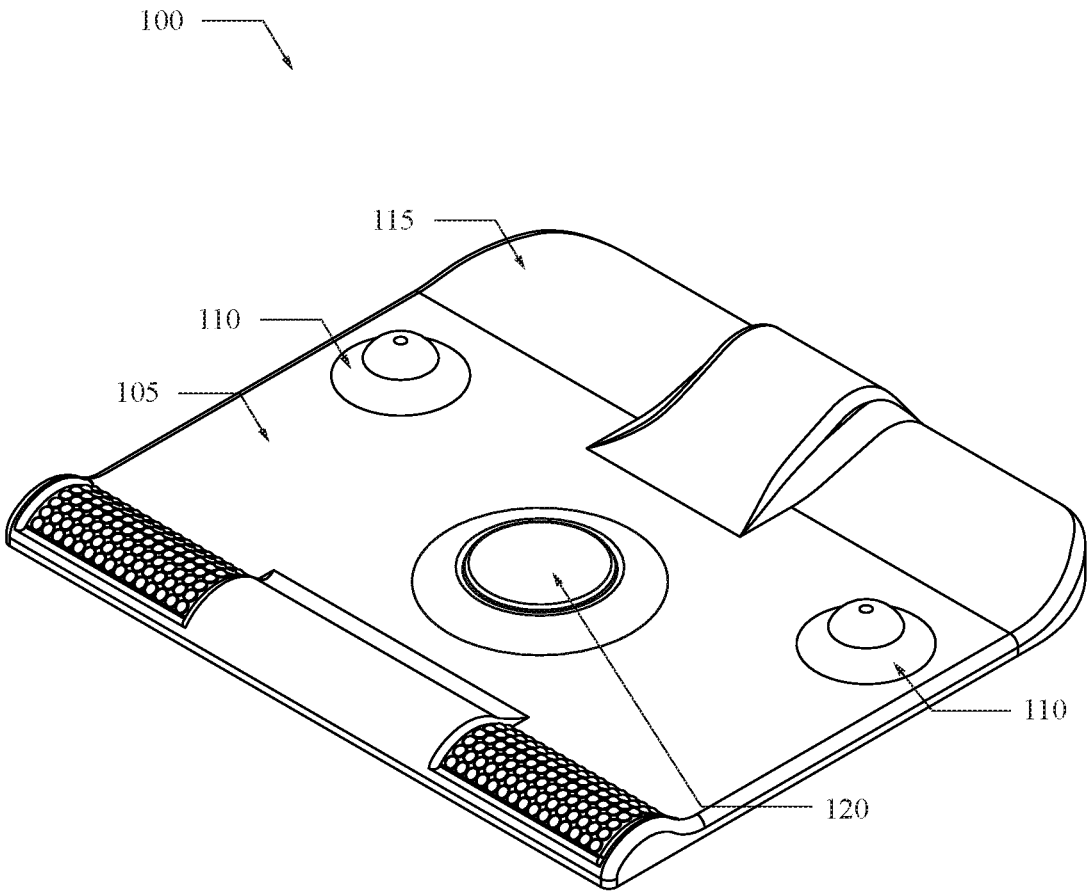
FIG. 7 is a perspective view of a second alternative improved anti-fatigue according to an embodiment of the present invention.
Figure 8A:
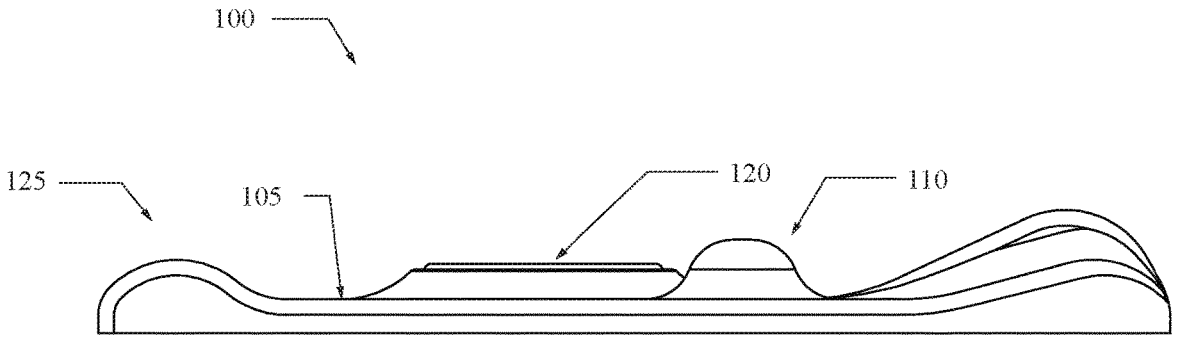
FIG. 8A is a side view of the second alternative improved anti-fatigue according to an embodiment of the present invention; and, FIG. 8B is a side view of a modified second alternative improved anti-fatigue according to an embodiment of the present invention.
Figure 8B:
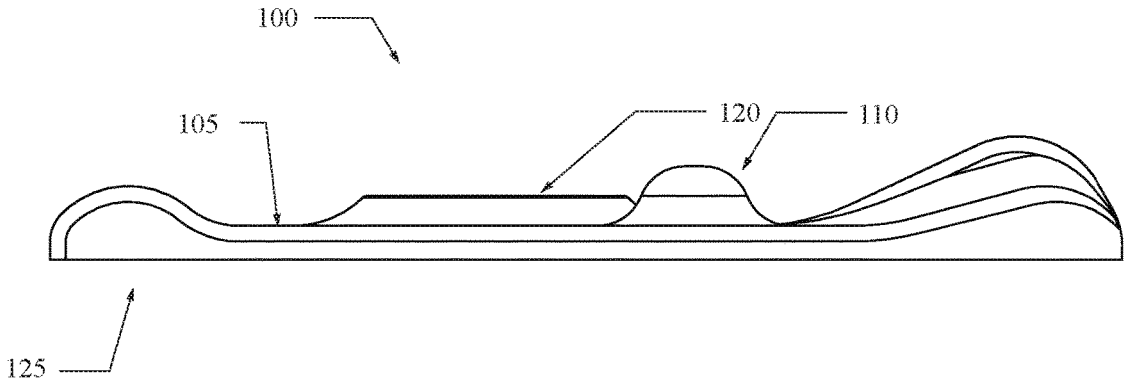

Referring now to FIG. 7, a perspective view of a second alternative improved anti-fatigue mat is illustrated. In this embodiment, the top surface of the base member 105 is sloped or includes a sloped portion, wherein the rotating disk 120 is embedded in the sloped portion. In FIGS. 7 and 8A, the top surface of the disk is approximate to at least a portion of the top surface of the base member, such as a top surface of the slope. Similarly, in FIG. 8B, the top surface of the disk is flush to at least a portion of the top surface of the base member, such as a top surface of the slope. The slope provides all the advantages discussed above for embedding the disk, but enabling the ability to use less material for the base member while still providing the necessary support. Further, the slope may be considered a feature for the user during use.

Although the invention has been described in considerable detail in language specific to structural features, it is to be understood that the invention defined in the appended claims is not necessarily limited to the specific features described. Rather, the specific features are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those skilled in the art. Such variations and alternate embodiments are contemplated, and can be made without departing from the spirit and scope of the invention.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. An improved anti-fatigue mat comprising:

a base member constructed from an elastomeric material, the base member having a base top surface configured to receive a foot or shoe of a user, wherein the top surface includes at least one raised surface on a boarder edge of the base member;

a central sloped portion of the base member having a disk partially embedded within the central sloped portion, wherein the disk is configured to rotate, the disk having a disk top surface, wherein the disk top surface is raised above a perimeter edge of a top portion of the central sloped portion.

2. The improved anti-fatigue mat of claim 1, wherein the disk top surface is flat.

3. The improved anti-fatigue mat of claim 1, wherein the disk is configured to rotate 360 degrees in both a clockwise and a counterclockwise direction.

4. The improved anti-fatigue mat of claim 1, wherein the elastomeric material is rubber, closed-cell foam, polypropylene, ploy-vinyl chloride, or a combination thereof.

5. The improved anti-fatigue mat of claim 1, further comprising a plurality of raised elements protruding from the top surface of the base member.

6. The improved anti-fatigue mat of claim 5, wherein at least one of the plurality of raised elements includes a textured surface to grip the foot or shoe of the user.

7. The improved anti-fatigue mat of claim 1, wherein the base member is rectangular.

* * * * *